US010358881B2

(12) United States Patent
Gao et al.

(10) Patent No.: US 10,358,881 B2
(45) Date of Patent: Jul. 23, 2019

(54) SELF-CLEANING FILTER

(71) Applicant: Halliburton Energy Services, Inc., Houston, TX (US)

(72) Inventors: Bo Gao, Spring, TX (US); Nicholas Budler, Claremore, OK (US); Linda Xin, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/571,516

(22) PCT Filed: Jul. 14, 2015

(86) PCT No.: PCT/US2015/040272
§ 371 (c)(1),
(2) Date: Nov. 3, 2017

(87) PCT Pub. No.: WO2017/010989
PCT Pub. Date: Jan. 19, 2017

(65) Prior Publication Data

US 2018/0128067 A1 May 10, 2018

(51) Int. Cl.
*E21B 21/00* (2006.01)
*E21B 21/10* (2006.01)
*E21B 43/08* (2006.01)

(52) U.S. Cl.
CPC ..... *E21B 21/002* (2013.01); *E21B 21/10* (2013.01); *E21B 43/086* (2013.01)

(58) Field of Classification Search
CPC ..... E21B 21/002; E21B 43/086
See application file for complete search history.

(56) References Cited

U.S. PATENT DOCUMENTS 2,627,925 A * 2/1953 Scivally ..... E21B 37/02 15/104.095
7,188,688 B1 3/2007 LeJeune et al.
7,487,831 B2 2/2009 Pluchek et al.
8,651,181 B2 2/2014 Knobloch et al.
(Continued)

FOREIGN PATENT DOCUMENTS

EP 0450170 10/1991
EP 1413709 7/2010
(Continued)

OTHER PUBLICATIONS

International Patent Application No. PCT/US2015/040272 , "International Search Report and Written Opinion", dated Apr. 1, 2016, 11 pages.

(Continued)

*Primary Examiner* — David J Bagnell
*Assistant Examiner* — Brandon M Duck
(74) *Attorney, Agent, or Firm* — Kilpatrick Townsend & Stockton LLP

(57) ABSTRACT

An assembly can include a filter body having an open end and a closed end. The filter body can also include a plurality of perforations. A fan may be positionable within the filter body. The fan may include a mount that extends along a length of the fan. A blade may be coupled to and extend from the mount. The fan may also include an outer edge of the blade for contacting an inner surface of the filter body.

19 Claims, 5 Drawing Sheets

(56) References Cited

U.S. PATENT DOCUMENTS

| | | | | |
|---|---|---|---|---|
| 2001/0042623 | A1* | 11/2001 | Reynolds | E21B 33/16 166/312 |
| 2004/0084177 | A1 | 5/2004 | Wang et al. | |
| 2010/0236833 | A1 | 9/2010 | Hall et al. | |
| 2013/0168091 | A1 | 7/2013 | Xu et al. | |

FOREIGN PATENT DOCUMENTS

| | | |
|---|---|---|
| JP | 2013150947 | 8/2013 |
| WO | 0151766 | 7/2001 |

OTHER PUBLICATIONS

Weatherford , "MudMaster II Filter Shoe and Auto-Fill Float Equipment", retrieved from the internet at http://www.weatherford.com/doc/wft022658, at least as early as May 5, 2015, 4 pages.

Canadian Patent Application No. 2,987,575, Office Action, dated Sep. 4, 2018, 5 pages.

* cited by examiner

SELF-CLEANING FILTER

TECHNICAL FIELD

The present disclosure relates generally to wellbore drilling and completion. More specifically, but not by way of limitation, this disclosure relates to filter assemblies for use in controlling the entry of debris and particulate materials into a casing string.

BACKGROUND

During completion of the wellbore the annular space between the wellbore wall and a casing string (or casing) can be filled with cement. This process can be referred to as "cementing" the wellbore. The casing string can include floating equipment, for example a float collar and a guide shoe. Fluid, such as drilling fluid or mud, can be present within the wellbore. The fluid can include debris particles. The fluid, including the debris particles, can enter the casing string and can come in contact with the floating equipment. The debris particles can partially or fully clog the valves of the floating equipment and may contaminate the cement. The floating equipment can fail to properly function during the cementing of the wellbore when the valves are partially or fully clogged. The cement job can be weak or otherwise fail to properly function when the floating equipment fails to properly function, for example due to clogged valves or the resulting contaminated cement.

DETAILED DESCRIPTION

Certain aspects and features of the present disclosure are directed to a filter assembly for preventing debris particles (or other types of particles) from entering floating equipment within a casing string. The filter assembly can include a filter body that has an open end and a closed end. The filter body can include multiple perforations, for example but not limited to, circular perforations, triangular perforations, oval perforations slits, slots, or other suitable openings for fluid to pass through the filter body. The perforations can each have the same width. Fluid can flow into the filter body through the open end and pass through the perforations. The fluid can include debris particles. The debris particles that have a width that is larger than the width of the perforations can be stopped by the apertures.

The filter assembly can also include a fan that can be positioned within the filter body. The fan can include blades that rotate as a result of fluid flowing into the filter body and through the perforations in the filter body. The fan can rotate based on the force of the fluid flowing through the filter body. Each blade of the fan can also include a blade edge on the outer most edge of the fan blade. Each blade can be sized and shaped such that the blade edge contacts an inner surface of the filter body. The blade edge can comprise a material suitable for wiping, brushing, or otherwise forcing the debris particles that collect at the perforations in the filter body away from the perforations. Fluid can continue to flow through the perforations as debris particles collect in the filter body by the blade edges unclogging the perforations.

The filter assembly can be coupled to the casing string at the well site. In some aspects, the filter assembly can be coupled to a substitute piece of threaded pipe ("sub"). The sub that includes the filter assembly can be coupled to a casing tube of the casing string at the well site.

In some aspects the filter body can be generally cylindrical in shape. In some aspects the filter body can be generally conical, semi-spherical, or any other suitable shape. The blades of the fan can be shaped to contact the inner surface of the filter body. The filter body and the fan can be comprised of drillable material.

These illustrative aspects are given to introduce the reader to the general subject matter discussed here and are not intended to limit the scope of the disclosed concepts. The following sections describe various additional features and aspects with reference to the drawings in which like numerals indicate like elements, and directional descriptions are used to describe the illustrative aspects but, like the illustrative aspects, should not be used to limit the present disclosure.

Figure 1:
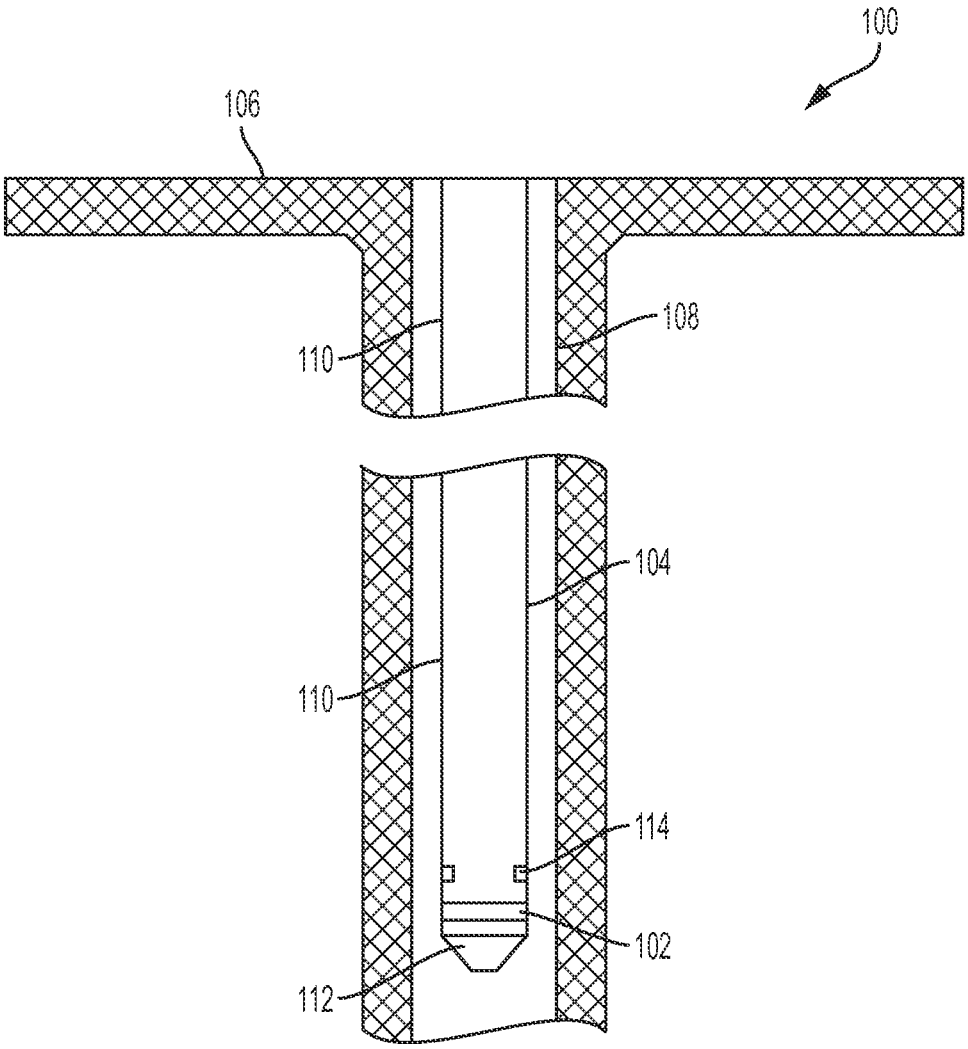
FIG. 1 is a schematic of a well system including a filter assembly positioned within a casing string, according to an aspect of the present disclosure.

FIG. 1 is a schematic of a well system 100 that includes a filter assembly 102 positioned within a tubing string, for example casing string 104. The casing string 104 can extend from a surface 106 of a wellbore 108 into a subterranean formation. The casing string 104 can be run into the wellbore 108 to protect or isolate formations adjacent to the wellbore 108. The casing string 104 can be comprised of multiple casing tubes 110 that can be coupled together at the surface 106 and positioned within the wellbore 108.

The casing string 104 can include a casing shoe 112. In some aspects, the casing shoe 112 can be a guide shoe or a float shoe. The casing shoe 112 can help guide the casing string 104 as it is positioned within the wellbore 108. The filter assembly 102 can be positioned within the casing string 104, for example above the casing shoe 112. In some aspects, the filter assembly 102 can be positioned elsewhere in the casing string 104, for example but not limited to in the casing shoe 112.

The casing string 104 can include floating equipment 114, for example but not limited to a float collar or a guide shoe. The floating equipment 114 can be used during cementing of the wellbore 108. The floating equipment 114 can include valves that can become fully or partially clogged by debris particles that enters the casing string 104. The floating equipment 114 can fail to properly function when the valves are fully or partially clogged. The cementing of the wellbore 108 can be weak or otherwise fail to properly function when the floating equipment 114 fails to properly function or the cement is contaminated by debris particles.

The filter assembly 102 can filter debris particles from the fluid that enters the casing string 104. The filter assembly 102 can prevent the particles from entering the casing string 104 and partially or fully clogging the valves of the floating equipment 114 or contaminating the cement. In some aspects, the filter assembly 102 can prevent the debris particles from passing through the casing shoe 112 and clogging a valve of the casing shoe 112.

Figure 2:
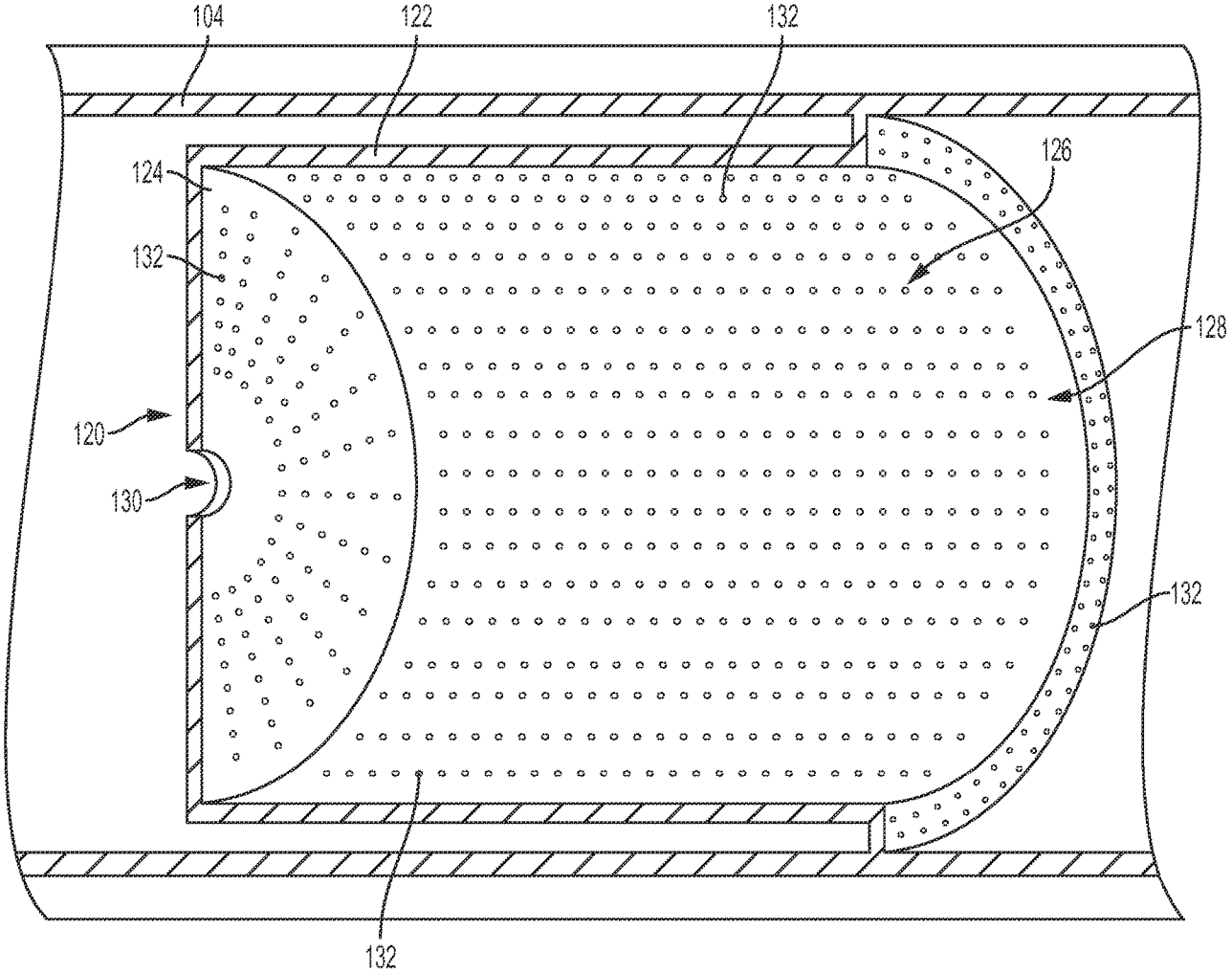
FIG. 2 is a cross-sectional view of an example of a filter body of the filter assembly of FIG. 1, according to an aspect of the present disclosure.

FIG. 2 is a cross-sectional view of a filter body 120 of the filter assembly 102 (shown in FIG. 1) positioned within the casing string 104. A fan 140 (shown in FIGS. 3 and 4) can be positioned inside the filter body 120 to form the filter assembly 102. The filter body 120 can be generally cylindrical in shape, though in some aspects other suitable shapes could be used, for example but not limited to a conical shape, a semi-spherical shape, or any other suitable shape. The filter body 120 can include a side panel 122 that can extend from and surround a base 124 of the filter body 120. The side panel 122 and the base 124 can together define a filter chamber 126. The filter body 120 can have an open end 128 that can provide access to the filter chamber 126. The open end 128 of the filter body 120 can be positioned downhole from the base 124 of the filter body 120. The filter body 120 can comprise drillable material, for example but not limited to a composite, phenolic, aluminum or other suitable drillable material.

The filter body 120 can be coupled to the casing string 104 proximate to the open end 128. In some aspects, the filter body 120 can be coupled the casing string 104 proximate to the base 124 or elsewhere along a length of the side panel 122 of the filter body 120. The base 124 of the filter body 120 can include an opening 130. The opening 130 can be generally circular in shape, though other suitable shapes for receiving a fan may be used as described in FIG. 4. In some aspects, the base 124 may include a recess instead of an opening to receive the fan. In some aspects, the fan can be coupled to open end 128 of the base 124, for example by including a frame on the open end 128 that can receive the fan.

The filter body 120 can include perforations, for example circular perforations 132. In some aspects, the perforations can be slots, slits, or other suitably shaped openings. In some aspects, the circular perforations 132 can be other suitable shapes including for example but not limited to, square, triangular, or oval. The circular perforations 132 can have a diameter in a range of approximately 0.1 mm to approximately 0.5 mm, though in some aspects other suitable diameters (or maximum widths) may be used. The diameter of the circular perforations 132 can be selected based characteristics of the well the filter body 120 will be used in. For example, in a well in which a high percentage of the debris particles in the fluid entering the casing string 104 have a width of 0.5 mm or larger, the filter body 120 may include circular perforations 132 having a diameter of 0.4 mm can be used. In a well in which a high percentage of the debris particles in the fluid entering the casing string 104 have a width of 0.2 mm or larger, a filter body 120 with circular perforations 132 having a diameter of 0.1 mm can be used. Other suitable widths may be used based on the characteristics of the fluid and debris particles within the fluid entering the casing string 104.

In some aspects, the circular perforations 132 all have the same diameter. In other aspects, the circular perforations 132 may vary in diameter. In some aspects, the circular perforations 132 can extend radially from an opening 130 in the base 124 of the filter body 120. The opening 130 can receive a portion of the fan 140 (shown in FIGS. 3 and 4). In some aspects, the circular perforations 132 can extend circumferentially about the opening 130, or in other random or non-random positions relative to the opening 130. The circular perforations 132 can extend linearly along the length of the side panel 122 of the filter body 120, as depicted in FIG. 2. In some aspects, the circular perforations 132 can be positioned circumferentially around the side panel 122. In some aspects, the circular perforations 132 can be positioned in a random or in another nonrandom distribution pattern in the side panel 122.

The filter body 120 can be in a range of approximately 1 foot to approximately 6 feet in length. The length of the filter body 120 can be selected based on the characteristics of the well the filter body 120 will be used in. For example, in a well in which the fluid entering the casing string 104 has a high concentration of debris particles the filter body 120 can be, for example, in a range of approximately 4 feet to approximately 6 feet in length. In a well in which the fluid entering the casing string 104 has a low concentration of debris particles the filter body 120 can be shorter. The filter body 120 can be coupled to the casing string 104 proximate to the open end 128. In some aspects, the casing string 104 can be a sub that can be in a range of approximately 2 feet to approximately 40 feet in length and can be coupled to a casing tube of the casing string 104.

The filter body 120 can be positioned within the casing string 104 with the open end 128 facing in a downhole direction. Fluid flowing into the casing string 104 can enter the filter chamber 126 of the filter body 120 at the open end 128. The fluid can pass through the circular perforations 132 in the filter body 120. The debris particles within the fluid that have a width greater than the diameter of the circular perforations 132 can stopped at the circular perforations 132.

Figure 3:
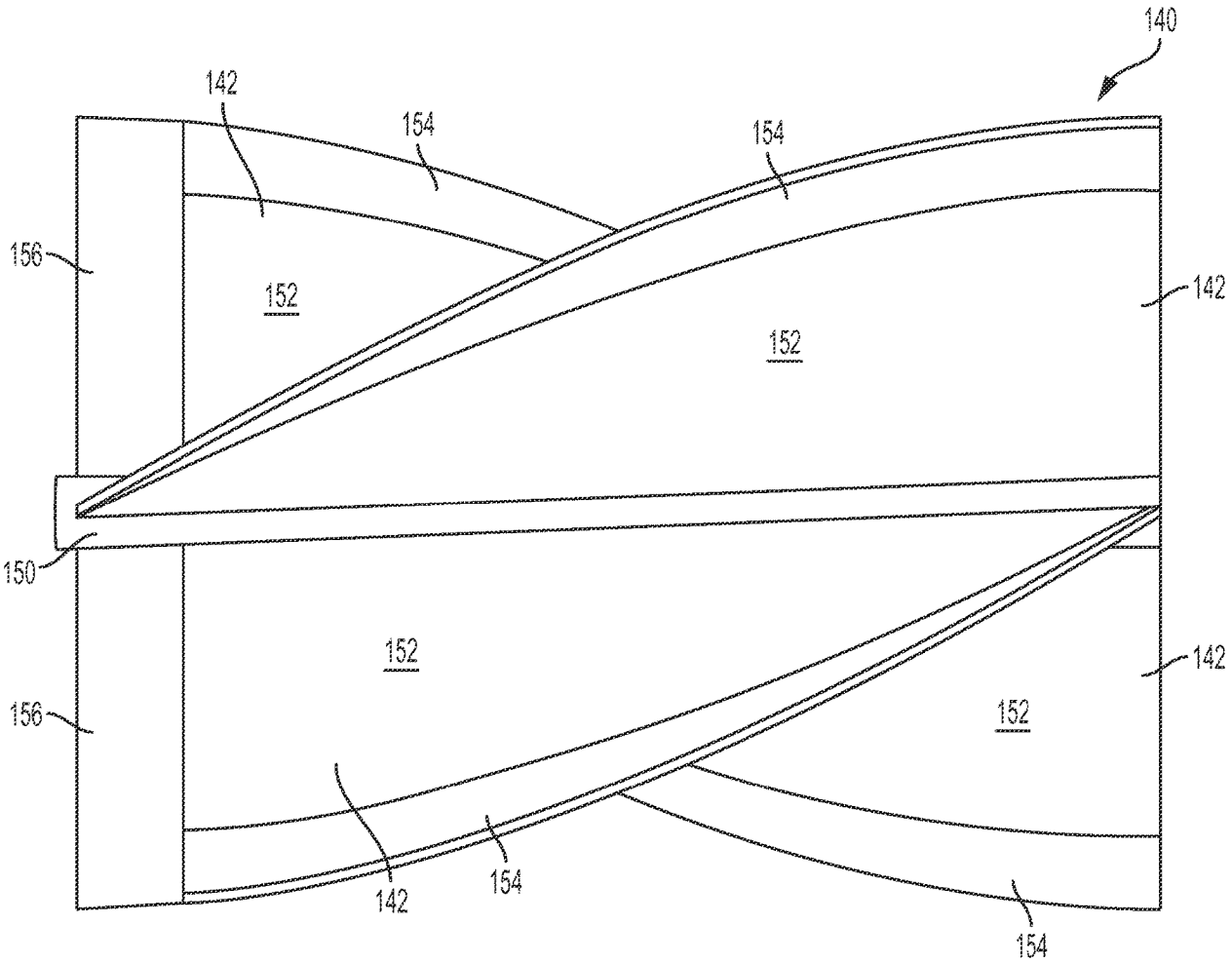
FIG. 3 is a side view of an example of a fan element of the filter assembly of FIG. 1, according to an aspect of the present disclosure.
Figure 4:
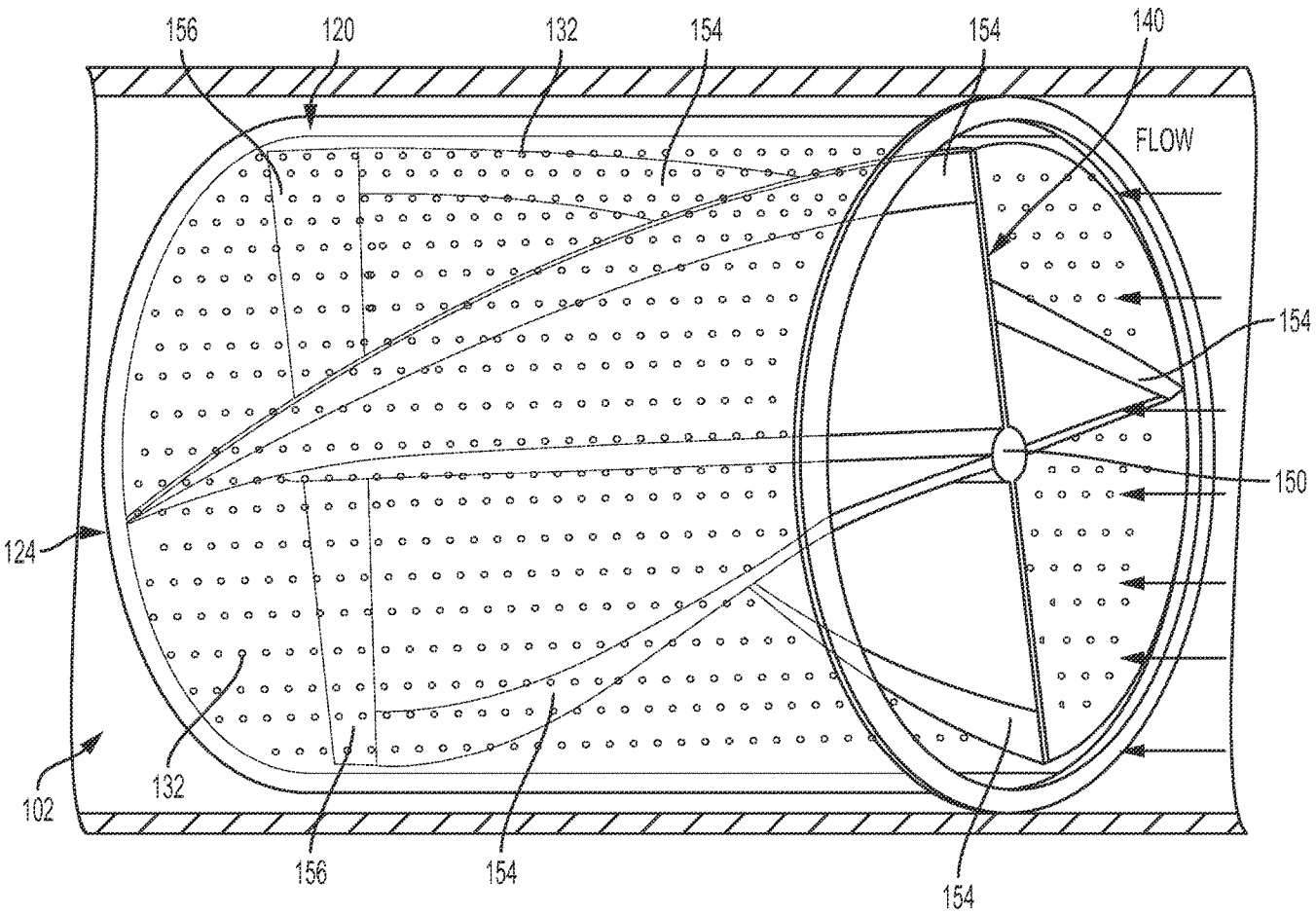
FIG. 4 is a perspective view of the filter assembly that includes the filter body and the fan element, according to an aspect of the present disclosure.

FIG. 3 depicts a fan 140 that can be positioned within the filter body 120 (shown in FIGS. 2 and 4) to form the filter assembly 102 (shown in FIGS. 1 and 4). The fan 140 can include blades 142 coupled to a mount 150. The mount 150 can have a circular cross section and can extend from a first end to a second end along a length of the fan 140. An end of the mount 150 can be positionable within the opening in the base of the filter body 120 (shown in FIG. 2). In some aspects the mount 150 can be coupled to the filter body 120 in another suitable manner, for example but not limited to a concave shapes recess. The blades 142 can extend from the mount 150. Each of the blades 142 can extend at least partially around a circumference of the mount 150. In other words, each of the blades 142 can have a first end that is offset from a second end.

The blades 142 and the mount 150 can be comprised of a drillable material, for example but not limited to a composite, phenolic, aluminum or other suitable drillable material. The blades 142 can each include a blade body 152 and a blade edge 154. The blade edge 154 can extend along a length of the blade 142 between the first end and a second end of each of the blades 142. The blades 142 can also include a rear blade edge 156 that can extend generally perpendicularly from the mount 150.

The blade edges 154 and rear blade edges 156 can include a material that can move or force debris particles that gather along the inner surface of the filter body 120 away from the circular perforations 132 when installed as shown in FIG. 4. The blade edges 154 and rear blade edges 156 can include a rubber material that forms a wiper. In some aspects, the blade edges 154 and rear blade edges 156 can include multiple fibers or bristles that form a brush-like feature. In still yet some aspects, the blade edges 154 and rear blade edges 156 can include a malleable material that does not plastically deform that can force debris particles away from the circular perforations 132.

FIG. 4 depicts the fan 140 positioned within the filter body 120 to form the filter assembly 102. An end of the mount 150 can be positioned within the opening 130 (shown in FIG. 2) in the filter body 120. The mount 150 can be shaped to fit within the opening such that the mount 150 can rotate within the opening. The rear blade edges 156 can be in contact with or proximate to the base 124 of the filter body 120. The fan 140 can rotate as fluid enters and passes through the circular perforations 132 in the filter body 120. The fan 140 can rotate due to the hydraulic force of the fluid passing through the filter body 120. The debris particles within the fluid that are larger than the width of the circular perforations 132 can collect along the inner surface of the filter body 120. The debris particles can clog the circular perforations 132 if they remain on the inner surface of the filter body 120.

The blade edges 154 can contact the inner surface of the filter body 120. As the fan 140 rotates the blade edges 154 can move the debris particles that have collected along the inner surface of the side panel 122 away from the circular perforations 132. The fan 140 can prevent the debris particles from clogging the circular perforations 132. The rear blade edges 156 can contact the inner surface of the base 124 of the filter body 120 and can force of the debris particles away from the circular perforations 132. The circular perforations 132 in the base 124 and side panel 122 of the filter body 120 can remain unclogged by the rear blade edges 156 and blade edges 154 so fluid may flow through the circular perforations 132.

In some aspects, the filter assembly may include multiple filter bodies and fans. For example, the filter assembly may include a first filter body and fan that are positioned downhole relative to a second filter body and fan. The first filter body and fan may include perforations that have a larger maximum diameter than the second filter body and fan that is positioned above the first filter body and fan. The use of multiple filter bodies and fans can extend the length of the time the filter assembly is functional. The number of filter bodies and fans in the filter assembly can be determined based on the characteristics of the well, for example in a well having a high concentration of debris particles more filter bodies and fans may be used as compared to a well having a lower concentration of debris particles.

Figure 5:
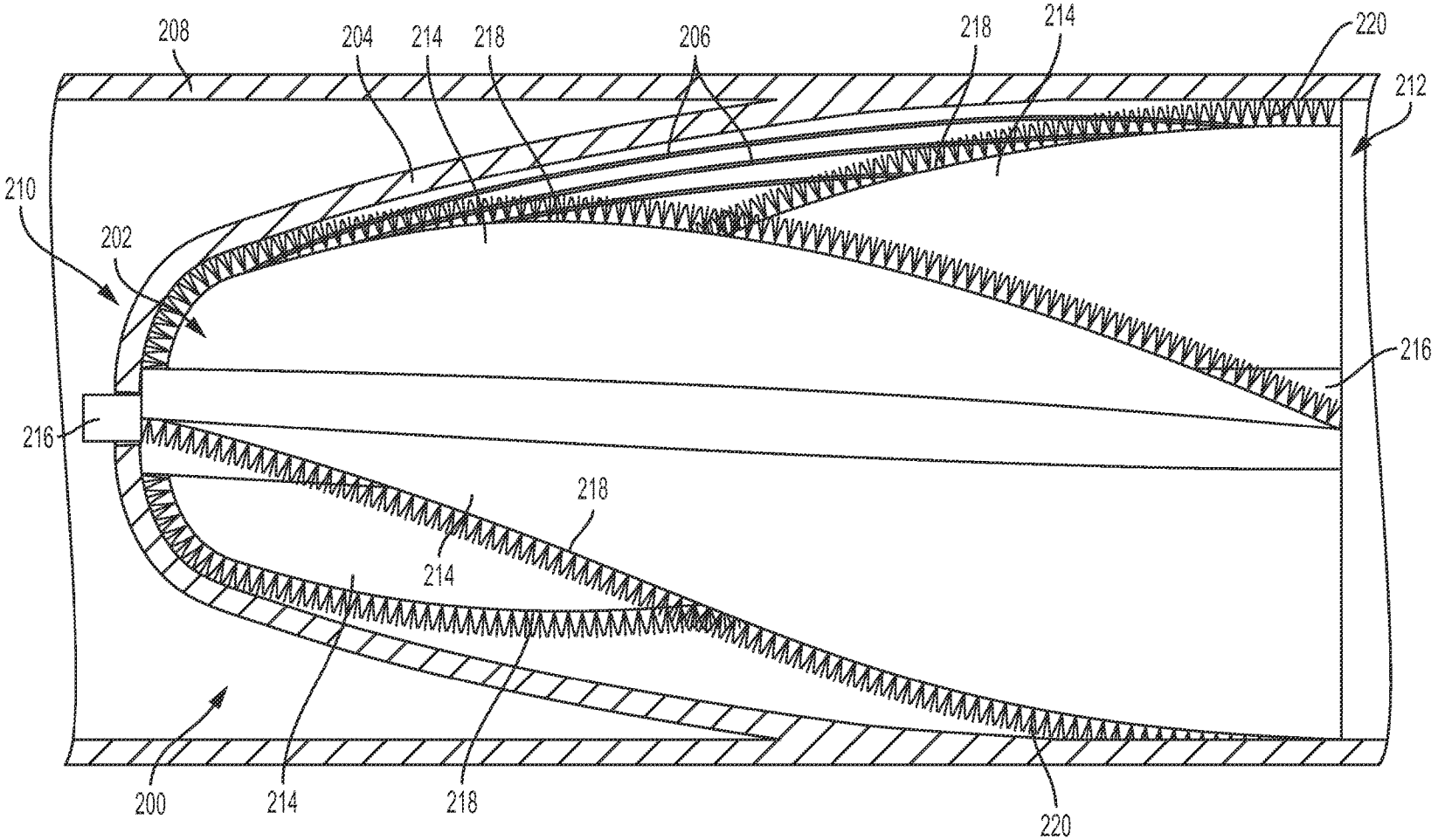
FIG. 5 is a partial cross-sectional view of another example of a filter assembly that includes a filter body and a fan element, according to another aspect of the present disclosure.

FIG. 5 shows a partial cross-sectional view of a filter body 204 of a filter assembly 200 with a fan 202 positioned within the filter body 204, according to another aspect of the present disclosure. The filter body 204, shown in a cross-sectional view, can be generally conical in shape and can include a plurality of perforations, for example slots 206. The filter body 204 can be coupled to a casing string 208. The filter body 204 can have a minimum diameter proximate to the apex 210 and a maximum diameter proximate to an open end 212.

The fan 202 can include blades 214 that extend along a length of a mount 216. The blades 214 can have a varying width along the length of the blades that can correspond to the radius of the filter body 204. The width of the blades 214 can be such that an edge 218 of each of the blades 214 is in contact with or proximate to an inner surface of the filter body 204. The edges 218 of the fan 202 can include a brush-like material, for example fibers 220. The fibers 220 can be rubber material or other suitable material. In other aspects, the edges 218 can include a length of rubber material, for example a wiper-like element. In some aspects, another suitable malleable material that does not plastically deform may be positioned at the blade edges 218 for forcing the debris particles away from the slots 206. For example, the edges 218 of the blades 214 can be comprised of materials as described in reference to FIGS. 3 and 4. The blades 214 of the fan 202 can rotate due to the hydraulic force of the fluid passing through the filter body 204. The edges 218 of the fan 202 can brush, sweep, or wipe away particles that collect at the slots 206. The slots 206 can be uniform in their width or can have various widths. In some aspects, the width of each individual slot 206 may vary along the length of the slot.

Example #1

An assembly can include a filter body that can have an open end and a closed end. The filter body can include a plurality of perforations. The assembly can also include a fan positionable within the filter body. The fan can include a mount, a blade, and an outer edge of the blade. The mount can extend along a length of the fan. The blade can be coupled to and extend from the mount. The outer edge of the blade can be for contacting an inner surface of the filter body.

Example #2

The assembly of Example #1 may feature the filter body having an opening in the closed end of the filter body. The opening can be for receiving an end of the mount.

Example #3

Any of the assemblies of Examples #1-2 may feature the filter body being generally cylindrical in shape.

Example #4

Any of the assemblies of Examples #1-3 may feature the outer edge comprising a rubber material for wiping the inner surface of the filter body.

Example #5

Any of the assemblies of Examples #1-3 may feature the outer edge of the blade comprising a plurality of fibers for sweeping the inner surface of the filter body.

Example #6

Any of the assemblies of Examples #1-5 may feature the blade extending at least partially circumferentially around the mount.

Example #7

Any of the assemblies of Examples #1-6 may feature the filter body being coupled to the inner surface of a casing string.

Example #8

Any of the assemblies of Examples #1-7 may feature the filter body and the fan both comprising a drillable material.

Example #9

An assembly may comprise a fan positionable within a filter body that has a plurality of perforations. The fan may include a mount, a blade, and an outer edge of the blade. The mount may extend along a length of the fan. The blade may be coupled to and extend from the mount. The blade may have a width that corresponds to a radius of the filter body. The outer edge of the blade may be for contacting an inner surface of the filter body.

Example #10

The assembly of Example #9 may feature the filter body having an open end and a closed end.

Example #11

Any of the assemblies of Examples #9-10 may feature the filter body being generally cylindrical in shape. The filter body may include a closed end having an opening for receiving the mount of the fan.

Example #12

Any of the assemblies of Examples #9-11 may feature the filter body being coupled to the inner surface of a casing string.

Example #13

Any of the assemblies of Examples #9-12 may feature the fan and the filter body both comprising a drillable material.

Example #14

Any of the assemblies of Examples #9-13 may feature the filter body being generally conical in shape.

Example #13

Any of the assemblies of Examples #9-14 may feature the plurality of perforations being slots.

Example #16

An assembly may include a filter body that comprises a closed end, an open end, and a plurality of perforations. The open end of the filter body can receive a fan having a blade for brushing an inner surface of the filter body in response to a fluid flowing into the filter body. The plurality of perforations can be for stopping a particle of debris within the fluid.

Example #17

The assembly of Example #16 may feature the blade of the fan having a width that corresponds to a radius of the filter body.

Example #18

Any of the assemblies of Examples #16-17 may feature the plurality of perforations being slots.

Example #19

Any of the assemblies of Examples #16-18 may feature the blade of the fan having an outer edge of the blade that includes a rubber material for brushing the inner surface of the filter body in response to the fluid flowing into the filter body.

Example #20

Any of the assemblies of Examples #16-19 may feature the filter body being coupled to a casing string.

Example #21

Any of the assemblies of Examples #16-20 may include an opening in the closed end for receiving a portion of the fan.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A downhole assembly for use in a casing string comprising:

a filter body positionable within the casing string, the filter body having an open end and a closed end, the filter body including a plurality of perforations; and a fan positionable within the filter body, the fan comprising:

a mount that extends along a length of the fan;

a blade coupled to and extending radially from the mount, the blade having a first end and a second end, wherein the second end is offset from the first end and wherein the blade is rotatable in response to a fluid flow from the first end of the blade to the second end of the blade; and an outer edge of the blade for contacting an inner surface of the filter body.

2. The assembly of claim 1, wherein the closed end of the filter body includes an opening for receiving an end of the mount.

3. The assembly of claim 1, wherein the filter body is generally cylindrical shape.

4. The assembly of claim 1, wherein the outer edge comprises a rubber material for wiping the inner surface of the filter body.

5. The assembly of claim 1, wherein the outer edge of the blade comprises a plurality of fibers for sweeping the inner surface of the filter body.

6. The assembly of claim 1, wherein the blade extends at least partially circumferentially around the mount.

7. The assembly of claim 1, wherein the filter body is coupled to the inner surface of a casing string.

8. The assembly of claim 1, wherein the filter body and the fan both comprise a drillable material.

9. A downhole assembly for use in a casing string comprising:

a fan positionable within a filter body having a plurality of perforations, the fan comprising:

a mount that extends along a length of the fan;

a blade coupled to and extending radially from the mount, the blade, the blade having a first end and a second end, wherein the second end is offset from the first end, and the blade having a width that corresponds to an inner radius of the filter body; and an outer edge of the blade for contacting an inner surface of the filter body.

10. The assembly of claim 9, wherein the filter body has an open end and a closed end.

11. The assembly of claim 9, wherein the filter body is generally cylindrical in shape and includes a closed end having an opening for receiving the mount of the fan.

12. The assembly of claim 9, wherein the filter body is coupled to the inner surface of a casing string.

13. The assembly of claim 9, wherein the fan and the filter body both comprise a drillable material.

14. The assembly of claim 9, wherein the filter body is generally conical in shape.

15. The assembly of claim 9, wherein the plurality of perforations are slots.

16. A downhole assembly for use in a casing string comprising:

the casing string; and a filter body coupled to the casing string, the filter body further comprising:

a closed end;

an open end for receiving a fan having a blade for brushing an inner surface of the filter body in response to a fluid flowing into the filter body; and a plurality of perforations for permitting a fluid to flow through the filter body, the plurality of perforations sized to prevent a particle of debris within the fluid from passing through the filter body, wherein the closed end includes an opening for receiving a portion of the fan.

17. The assembly of claim 16, further comprising the fan, wherein the blade of the fan has a width that corresponds to a radius of the filter body.

18. The assembly of claim 16, wherein the plurality of perforations are slots.

19. The assembly of claim 16, further comprising the fan wherein the blade of the fan includes an outer edge of the blade that includes a rubber material for brushing the inner surface of the filter body in response to the fluid flowing into the filter body.

* * * * *